United States Patent [19]

Misoo et al.

[11] Patent Number: 5,043,216

[45] Date of Patent: Aug. 27, 1991

[54] POROUS POLYETHYLENE FIBERS

[75] Inventors: Kunio Misoo; Kiyonobu Okamura; Hironari Honda, all of Toyohashi, Japan

[73] Assignee: Mitsubishi Rayon Co., Ltd., Tokyo, Japan

[21] Appl. No.: 371,800

[22] Filed: Jun. 27, 1989

[30] Foreign Application Priority Data

Jun. 27, 1988 [JP] Japan ..... 63-158957

[51] Int. Cl.[5] ..... D02G 3/00

[52] U.S. Cl. ..... 428/397; 428/376; 428/398; 428/401

[58] Field of Search ..... 428/376, 398, 397, 401; 264/41, 49

[56] References Cited

U.S. PATENT DOCUMENTS

| | | | |
|---|---|---|---|
| 4,401,567 | 8/1983 | Shindo et al. | 428/398 X |
| 4,405,688 | 9/1983 | Lowery et al. | 428/398 |
| 4,859,535 | 8/1989 | Shinomura et al. | 428/398 |

FOREIGN PATENT DOCUMENTS

| | | |
|---|---|---|
| A2041821 | 9/1980 | European Pat. Off. . |
| A0050399 | 4/1982 | European Pat. Off. . |
| A0147849 | 7/1985 | European Pat. Off. . |

*Primary Examiner*—Lorraine T. Kendell

*Attorney, Agent, or Firm*—Oblon, Spivak, McClelland, Maier & Neustadt

[57] ABSTRACT

Disclosed are porous polyethylene fibers without a central cavity extending along the longitudinal axis thereof, and having (a) a porous structure containing pores defined by lamellar crystal portions and a large number of fibrils interconnecting the lamellar crystal portions, the pores communicating with each other anywhere from the surface to the center of the fiber, (b) a porosity of 50 to 80%, (c) a tensile strength of 1 to 8 g/d, and (d) an elongation of 1 to 300%.

These porous polyethylene fibers do not exhibit the waxy feeling characteristic of polyethylene, have very light weight and a soft feeling, and are useful as a high-strength fiber material for the manufacture of clothing.

4 Claims, 2 Drawing Sheets

POROUS POLYETHYLENE FIBERS

BACKGROUND OF THE INVENTION

1. Field of the Invention

This invention relates to porous polyethylene fibers having very light weight and a soft feeling.

2. Prior Art

In recent years, the diversty of fibers for use in clothing has increased greatly. As a part of this diversity, there is a growing demand for fibers having lighter weight and a softer feeling.

Fibers in ordinary form have a limit in light-weight properties, depending on the material. If crimping is used, the resulting fibers inevitably have a feeling characteristic of crimped fibers. The same is the case with soft feeling. Thus, fibers made on different principles are being required for purposes of diversity.

In order to meet this demand, the present inventors attempted to develop a new material comprising porous fibers.

A variety of porous fibers have been proposed in the prior art. They include, for example, those prepared by melt-spinning a blend of a thermoplastic polymer and a blowing agent, and decomposing the blowing agent during spinning to make the spun fibers porous; those prepared by melt-spinning a blend of a thermoplastic polymer and another component such as inorganic fine particles or an incompatible polymer, and then stretching the spun fibers to form empty spaces at the interface between the thermoplastic polymer and the other component; those prepared by spinning a blend of a thermoplastic polymer and an extractable substance, and then extracting the extractable substance with a suitable solvent to produce pores; and those prepared by forming polyester filaments having a specific structure and treating them with an amine and an alkali to produce a porous structure (as in Japanese Patent Laid-Open No. 179369/'86).

However, the process using a blowing agent fails to yield porous fibers of consistent quality, probably because the spinning step has poor stability. If an attempt is made to enhance the porosity, fiber breakage occurs frequently and a marked reduction in strength results. Thus, it is impossible to obtain fibers having both high porosity and high strength. The process using inorganic fine particles or an incompatible polymer to prepare porous fibers has the disadvantage that it is difficult to blend such an additive uniformly with the thermoplastic polymer. If a large amount of additive is added in order to enhance the porosity, the additive prevents full orientation of the sea component constituting the fibers proper, making it impossible to obtain porous fibers having high strength. Thus, this process also fails to achieve the desired combination of high porosity and high strength. The extraction process is also disadvantageous in that it involves complicated steps which raise the cost of the fibers and, as in the above-described processes, it is impossible to obtain porous fibers having high porosity and high strength. The process described in Japanese Patent Laid-Open No. 179369/'86 involves complicated steps and, moreover, cannot be applied to materials other than polyesters. Furthermore, judging from the examples described therein, even fibers having a porosity of as low as 35–45% exhibit a tensile strength of 2.9 g/d or less. Thus, the desired combination of high porosity and high strength again cannot be achieved.

A process for preparing porous fibers by melt spinning and stretching is disclosed in U.S. Pat. No. 3,549,743. It is described therein that porous polypropylene fibers can be prepared by this process, but the fibers thus obtained have an apparent density of 50 to 85% and hence a porosity of 15 to 50%. Thus, no fibers having a porosity greater than 50% are disclosed therein.

A similar process for preparing porous polyethylene hollow fibers by melt spinning and stretching is disclosed in U.S. Pat. No. 4,401,567. However, those fibers have larger diameters (i.e., not less than 50 μm in inner diameter and not less than 70 μm in outer diameter) than ordinary fibers. Although it is known that hollow fibers having such large diameters can be obtained, it is not easy to prepare ordinary fibers having smaller diameters. More specifically, in preparing porous fibers according to the process disclosed in U.S. Pat. No. 4,401,567, it is necessary to obtain unstretched fibers having a high degree of crystal orientation. To this end, a high-density polyethylene having a relatively low melt index is subjected to high-draft spinning at a temperature lower than the usual spinning temperature. Accordingly, in order to obtain ordinary fibers having a smaller diameter, higher-draft spinning conditions must be established by either sharply increasing the spinning speed or sharply decreasing the extrusion rate.

Under these conditions, however, fiber breakage tends to occur just under the spinneret owing to the marked increase in tension, resulting in reduced spinning stability. Moreover, since the elongation of the unstretched fibers is markedly reduced, high stretching ratios cannot be established in the stretching step. Thus, it is difficult to achieve a high porosity of 50% or greater.

On the other hand, as disclosed in U.S. Pat. No. 3,549,743, polypropylene can be relatively stably spun to obtain unstretched fibers which have a small diameter and can be made porous. However, the porous polypropylene fibers so prepared have smaller micropores than porous polyethylene fibers. If the stretching ratio is increased, the rearrangement of molecular chains proceeds to cause the collapse of micropores and hence a reduction in porosity. Thus, it is again difficult to obtain porous fibers having a porosity of 50% or greater.

Thus, although polyolefins are materials suitable for the manufacture of healthful clothing, polyethylene is not used as a clothing material because of its characteristic waxy feeling. In view of those circumstances, the present inventors conducted an intensive study to greatly diminish the waxy feeling of polyethylene that is an inherently lightweight material, and thereby develop a novel material being very light weight an having high intensity. The present invention was completed as a result of this study.

SUMMARY OF THE INVENTION

It is an object of the present invention to provide polyethylene fibers which do not have the waxy feeling characteristic of polyethylene and which serve as a material suitable for the manufacture of hygienic wear and medical cloths free of additives and other impurities.

It is another object of the present invention to provide a fiber material for the manufacture of clothing which is very light weight and has a soft feeling, as well as high strength.

It is a further object of the present invention to provide a lipophilic adsorbent material having a very large surface area per unit weight or unit volume.

According to the present invention, there are provided porous polyethylene fibers without a central cavity extending along the longitudinal axis thereof, and having (a) a porous structure containing pores defined by lamellar crystal portions and a large number of fibrils interconnecting the lamellar crystal portions, the pores communicating with each other anywhere from the surface to the center of the fiber, (b) a porosity of 50 to 80%, (c) a tensile strength of 1 to 8 g/d, and (d) an elongation of 1 to 300%.

DETAILED DESCRIPTION OF THE PREFERRED EMBODIMENTS

The fibers of the present invention should have a porosity of 50 to 80%. Fibers having a porosity of less than 50% do not have light weight or a soft feeling, and tend to exhibit a waxy feeling. Fibers having a porosity of greater than 80% do not have sufficient strength because their porous structure may be easily destroyed. The preferred range of the porosity is from 55 to 75%.

As used herein, the porosity of a porous fiber is defined by the following equation.

$$\text{Porosity} = (1 - \rho_a/\rho_b) \times 100\ (\%)$$

where $\rho_a$ is the apparent density of the porous fiber and $\rho_b$ is the density of the non-porous matrix polymer constituting the fiber.

The fibers of the present invention should have a tensile strength of 1 to 8 g/d, preferably 2 to 6 g/d, and an elongation of 1 to 300%, preferably 5 to 150%. Fibers having a tensile strength of less than 1 g/d or a elongation of less than 1% are undesirable because they show a marked reduction in workability into textiles and fabrics. Fibers having an elongation of greater than 300% are also undesirable because they are lacking in morphological stability. Although a strength as high as possible is desirable, it is practically impossible to prepare fibers having a strength of greater than 8 g/d.

The reason that the fibers of the present invention are defined as ones without a central cavity extending along the longitudinal axis thereof is that hollow fibers are undesirable because they inevitably have unduly large diameters and, therefore, cloth made thereof has an strange touch and feeling. Moreover, hollow fibers also have the disadvantage that their surface area per unit volume cannot be increased sufficiently.

The fineness (as expressed in deniers per filament) of the porous fibers of the present invention may be of the same order as that of ordinary filaments heretofore in common use for clothing purposes. However, finenesses of 0.5 to 5 deniers per filament are preferred from the viewpoint of workability into textiles and fabrics.

Figure 1:
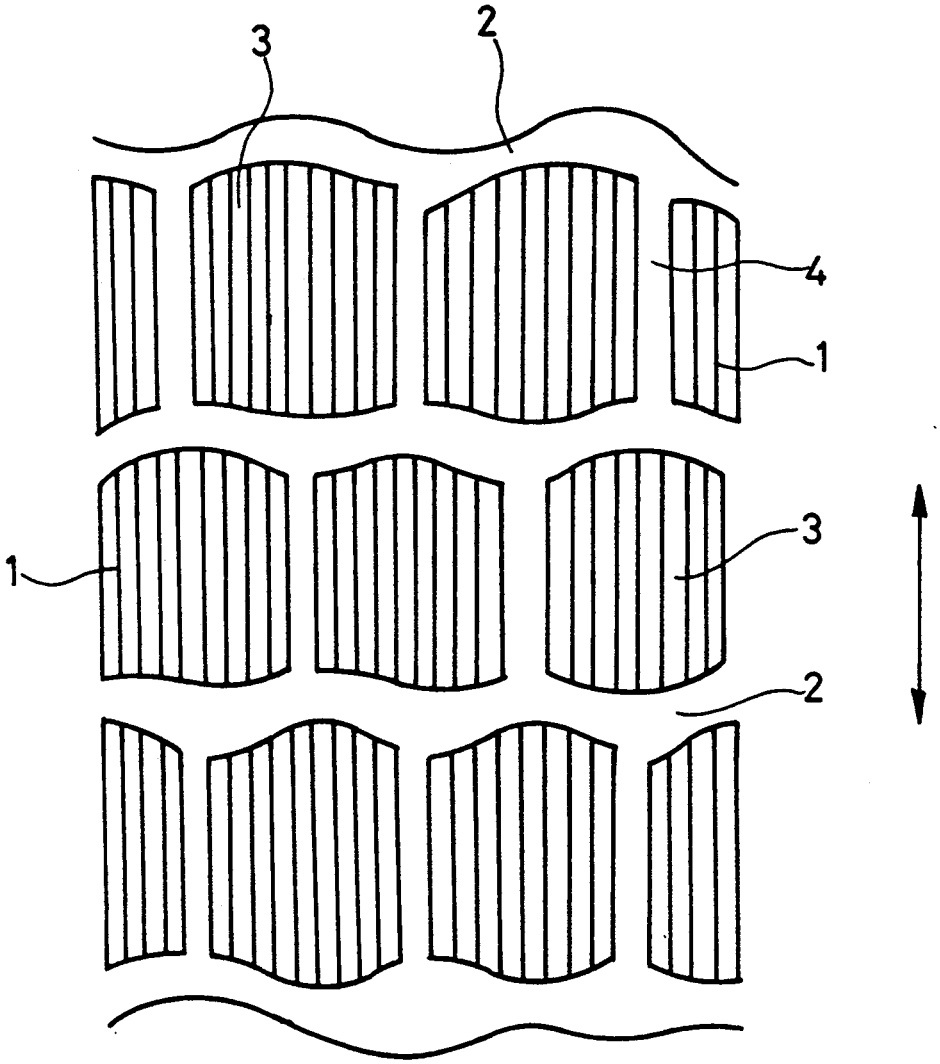
FIG. 1 is a schematic illustration of the porous structure possessed by the porous polyethylene fibers of the present invention.

The porous polyethylene fibers of the present invention have a porous structure containing pores defined by lamellar crystal portions and a large number of fibrils interconnecting the lamellar crystal portions, the pores communicating with each other anywhere from the surface to the center of the fiber. In other words, this porous structure is such that, as shown in FIG. 1, slit-like micropores are stacked in a vast number of layers. Referring to FIG. 1, reference numeral 1 denotes microfibrils, 2 lamellar crystal portions connected to microfibrils 1 substantially at right angles thereto, and 3 slit-like micropores formed by microfibrils 1 and lamellar crystal portions 2 and stacked with the interposition of lamellar crystal portions 2. Reference numeral 4 denotes portions thicker than microfibrils 1. Although their exact structure is unknown, they are considered herein to be aggregates of microfibrils. The stacked structure of micropores is regarded to be such that, when described in a schematic manner, the pores lying in a plane are stacked in the lengthwise direction of the fiber with the interposition of lamellar crystal portions as shown in FIG. 1 and, at the same time, planes having this configuration are stacked anywhere from the surface to the center of the fiber. Accordingly, the fibers having the above-described porous structure are characterized in that they have high strength because the polymer is fully oriented along the longitudinal axis of the fiber. Moreover, the fibers having the above-described porous structure exhibit a larger surface area than fibers having other porous structures because the pores communicate with each other and the surface of each microfibril is in contact with spaces open to the outside.

The porous polyethylene fibers of the present invention can be prepared in the following manner:

A high-density polyethylene having a density of not less than 0.955 g/cm$^3$ as measured according to the procedure of ASTM D-1505 is melt-spun through an ordinary spinneret for use in fiber spinning. The spun fibers are passed through a slow cooling zone provided beneath the spinneret and having a length of 1 to 3 m and a temperature of 50° to 100° C. therein, so that crystalline unstretched fibers are obtained. If a polyethylene having a density less than 0.955 g/cm$^3$ is used, no porous structure is produced even after the fibers have been subjected to the steps described hereinafter, or even if a porous structure is produced, it is not uniform. In any case when the density of polyethylene is less than 0.955 g/cm$^3$, the resulting fibers do not have a porous structure which contains pores communicating with each other anywhere from the surface to the center of the fiber, and fail to exhibit the high porosity desired in the present invention. The density of the polyethylene is preferably not less than 0.960 g/cm$^3$ and more preferably not less than 0.965 g/cm$^3$.

The spinning temperature should be higher than the melting point of the polymer by 20° to 80° C. If the spinning is performed at a temperature below the lower limit of this temperature range, the resulting unstretched fibers exhibit a very high degree of orientation, but a sufficient total amount of stretching cannot be achieved in the succeeding stretching steps for making the fibers porous. As a result, it is impossible to obtain fibers having a satisfactorily high porosity. On the other hand, if the spinning is performed at a temperature above the upper limit of the aforesaid temperature range, it is again impossible to obtain fibers having a satisfactorily high porosity.

The spinning draft should be of the order of 100 to 2,000 and preferably of the order of 200 to 1,000. By drawing the molten fibers at this spinning draft, a lamellar stack comprising highly oriented lamellar crystals can be formed in the unstretched fibers. This makes it easier to obtain fibers having the porous structure defined in the present invention as a result of the succeeding stretching steps. If the length of the slow cooling zone is less than 1 m or if the temperature thereof is lower than 50° C., the spun fibers tend to break just under the spinneret, causing a reduction in processing stability. On the other hand, if the length of the slow cooling zone is greater than 3 m or if the temperature thereof is higher than 100° C., the spun fibers are not fully cooled and the spinning draft is substantially reduced, making it impossible to obtain fibers having highly oriented crystals.

Although the spinneret used for forming unstretched fibers usually has circular holes, spinnerets having non-circular holes such as Y-shaped, X-shaped or rectangular holes can also be used.

When non-circular section fibers are made into textiles and non-woven fabrics, they show an improvement in bulkiness over circular section fibers having the same fineness and porosity, thus giving a very soft feeling. Moreover, where fibers are bundled in the form of a tow and a gas is caused to flow therethrough in the lengthwise direction of the fibers, as in case of cigarette filters, circular section fibers give a high packing density and thereby cause an increase in flow resistance. In such applications, therefore, the use of non-circular section fibers having greater bulkiness makes it possible to produce filters having low flow resistance, little liability to channeling, and hence good filtration efficiency.

As used herein, the term "non-circular section fiber" refers to a fiber having a cross-sectional shape whose non-circularity index (i.e., the ratio of the perimeter of the cross section of the fiber to the perimeter of the cross section of a circular section fiber having the same fineness and porosity) is not less than 1.2.

Although the unstretched fibers thus obtained can be directly stretched to make them porous, they may be stretched after they have been annealed at a temperature lower than the melting point of the polymer, preferably at 120° C. or below, under a constant-length or relaxed condition. The annealing time is usually in the range of about 60 to 180 seconds. However, especially where a polyethylene having a relatively low density is used, the annealing can be performed for a long period of time ranging from one hour to several tens of hours.

The fibers of the present invention are obtained by stretching them to make them porous. It is desirable that the stretching be performed in two stages consisting of cold stretching at a temperature ranging from −100° C. to about 40° C., preferably 10° to 30° C. and hot stretching at a temperature of 80° to 125° C. The hot stretching may be divided into two or more stages. In preparing the fibers of the present invention, the cold stretching is an important step in which the amorphous portion of the highly oriented, crystalline unstretched fibers is stretched to create microcracks therein. When the fibers are plastified and stretched in the succeeding hot stretching step, these microcracks are expanded to produce the above-described unique porous structure.

The cold stretching is preferably performed so as to give an amount of stretching of 5 to 100%. The hot stretching is preferably performed so that the total amount of stretching resulting from the cold and hot stretching steps is in the range of 100 to 700%, i.e., so that the length of the stretched fibers is 2 to 8 times as large as the original length of the unstretched fibers. More preferably, the hot stretching is performed so as to give a total amount of stretching of 150 to 600%. If the hot stretching temperature is higher than 125° C., the resulting fibers become transparent and do not have the desired porous structure. If the hot stretching temperature is lower than 80° C., the porosity is undesirably reduced as the temperature becomes lower. If the total amount of stretching is greater than 700%, fiber breakage tends to occur during the stretching. In the porous polyethylene fibers thus obtained, morphological stability is substantially established. If desired, however, they may be thermally set at a temperature of 80° to 125° C. under a taut or partially relaxed condition.

The present invention is further illustrated by the following examples.

Example 1

Using a spinneret having 40 holes with a diameter of 1.0 mm, a high-density polyethylene (Hizex 2200J, a product of Mitsui Petrochemical Industries) having a density of 0.968 g/cm3 and a melt index of 5.5 was spun at a spinning temperature of 180° C. and taken up at a speed of 600 m/min with a spinning draft of 614. The spun fibers were passed through a slow cooling zone provided beneath the spinneret and having a length of 2.5 m and an ambient temperature of 70° C. therein. The unstretched fibers thus obtained were heat-treated at 115° C. for 120 seconds under a constant-length condition, cold-stretched at 20° C. so as to give an amount of stretching of 80%, and then hot-stretched in a box having a length of 2 m and heated at 117° C. until the total amount of stretching reached 520%. Thereafter, the fibers were thermally set under a relaxed condition in a box having a length of 2 m and heated at 117° C., so as to give a total amount of stretching of 400%. The porous polyethylene fibers thus obtained had a porous structure containing pores defined by lamellae and a large number of fibrils interconnecting the lamellae, the pores communicating with each other anywhere from the surface to the center of the fiber. As a result, these fibers had a very soft feeling and exhibited a porosity of 66.7%, a strength of 4.86 g/d, an elongation of 39.5%, a fineness of 1.8 deniers per filament (dpf), and a dry heat shrinkage of 1.7%.

Figure 2:
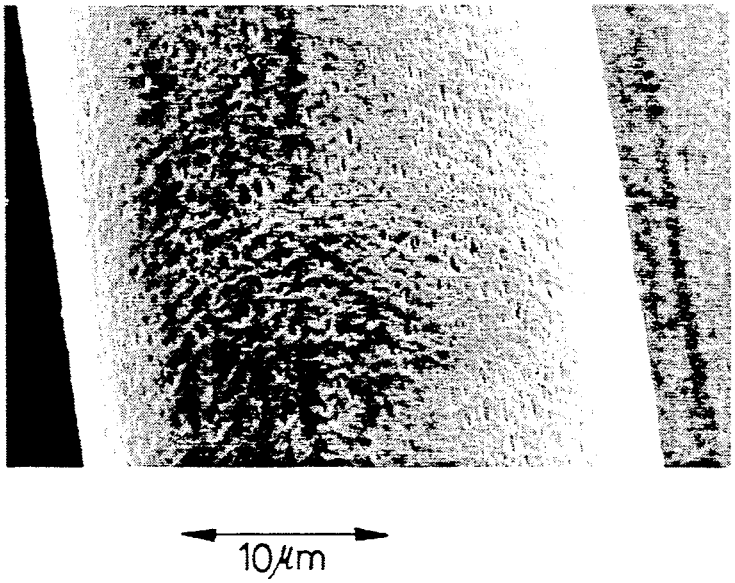
FIG. 2 is a scanning electron microphotograph showing the surface of a porous polyethylene fiber in accordance with the present invention.

When these porous polyethylene fibers were examined by means of a scanning electron microscope, the porous structure shown in FIG. 2 was observed. This porous structure is such that, as shown in FIG. 1, slit-like micropores are formed by microfibrils and lamellar crystal portions connected to the microfibrils substantially at right angles thereto and these micropores are stacked in a vast number of layers.

Example 2

The same high-density polyethylene as used in Example 1 was spun in the same manner as described in Example 1. The unstretched fibers thus obtained were heat-treated at 115° C. for 120 seconds under a constant-length condition, cold-stretched at 20° C. so as to give an amount of stretching of 80%, and then hot-stretched in a box having a length of 2 m and heated at 110° C. until the total amount of stretching reached 150%. Thereafter, the fibers were thermally set under a constant-length condition in a box having a length of 2 m and heated at 115° C. The porous polyethylene fibers thus obtained had a porous structure containing pores defined by lamellar crystal portions and a large number of fibrils interconnecting the lamellar crystsl portions, the pores communicating with each other anywhere from the surface to the center of the fiber. As a result, these fibers had a very soft feeling and exhibited a porosity of 52.3%, a tensile strength of 2.35 g/d, an elongation of 108%, an elastic recovery factor (from 50% stretching) of 24.1%, a fineness of 3.9 dpf, and a dry heat shrinkage of 1.7%.

Example 3

Using a spinneret having 40 holes with a diameter of 1.0 mm, a high-density polyethylene (Sholex F6080V, a product of Showa Denko K.K.) having a density of 0.960 g/cm$^3$ and a melt index of 8.0 was spun at a spinning temperature of 170° C. and taken up at a speed of 900 m/min with a spinning draft of 920. The spun fibers were passed through a slow cooling zone provided beneath the spinneret and having a length of 1.5 m and an ambient temperature of 85° C. therein. The unstretched fibers thus obtained were heat-treated at 115° C. for 20 hours under a 2% relaxed condition, cooled in an atmosphere at 25° C. for 3 hours, cold-stretched at 20° C. so as to give an amount of stretching of 100%, and then hot-stretched in a box having a length of 2 m and heated at 110° C. until the total amount of stretching reached 600%. Thereafter, the fibers were thermally set under a constant-length condition in a box having a length of 2 m and heated at 115° C. The porous polyethylene fibers thus obtained had a porous structure containing pores defined by lamellar crystal portions and a large number of fibrils interconnecting the lamellar crystal portions, the pores communicating with each other anywhere from the surface to the center of the fiber. As a result, these fibers had a very soft feeling and exhibited a porosity of 73.1%, a tensile strength of 5.20 g/d, an elongation of 6.5%, and a fineness of 0.7 dpf.

Examples 4–7

Porous polyethylene fibers were prepared in the same manner as described in Example 1, except that the hole diameter of the spinneret and the take-up speed were altered as shown in Table 1.

TABLE 1

| | Hole diameter (mm) | Take-up speed (m/min) | Spinning draft | Porosity (%) | Tensile strength (g/d) | Elongation (%) | Fineness (dpf) |
|---|---|---|---|---|---|---|---|
| Example 4 | 1.0 | 300 | 306 | 54.2 | 2.6 | 68.4 | 3.9 |
| Example 5 | 1.0 | 400 | 408 | 63.0 | 3.3 | 35.1 | 2.7 |
| Example 6 | 1.5 | 600 | 1,370 | 68.9 | 4.2 | 25.6 | 1.7 |
| Example 7 | 1.5 | 850 | 1,950 | 71.6 | 5.2 | 11.0 | 1.2 |

Examples 8–11

Porous polyethylene fibers were prepared in the same manner as described in Example 2, except that the total amount of stretching was altered as shown in Table 2.

TABLE 2

| | Total amount of stretching (%) | Porosity (%) | Tensile strength (g/d) | Elongation (%) | Fineness (dpf) |
|---|---|---|---|---|---|
| Example 8 | 100 | 50.1 | 1.9 | 196.3 | 4.8 |
| Example 9 | 300 | 67.3 | 3.8 | 28.2 | 2.3 |
| Example 10 | 500 | 72.4 | 5.0 | 12.5 | 1.4 |
| Example 11 | 700 | 74.3 | 5.4 | 8.5 | 1.0 |

Example 12

Using a spinneret having 40 Y-shaped holes with a cross-sectional area of 1.2 mm$^2$, a high-density polyethylene (Hizex 1300J, a product of Mitsui Petrochemical Industries) having a density of 0.965 g/cm$^3$ and a melt index of 13 was spun at a spinning temperature of 170° C. and taken up at a speed of 400 m/min with a spinning draft of 622. The spun fibers were passed through a slow cooling zone provided beneath the spinneret and having a length of 2.5 m and an ambient temperature of 60° C. therein. The unstretched fibers thus obtained were heat-treated at 115° C. for 8 hours under a constant-length condition, cold-stretched at 20° C. to a stretching amount of 100%, and then hot-stretched in a box having a length of 2 m and heated at 110° C. until the total amount of stretching reached 520%. Thereafter, the fibers were thermally set under a relaxed condition in a box having a length of 2 m and heated at 115° C., so as to give a total amount of stretching of 400%. The porous polyethylene fibers thus obtained had a distinctly Y-shaped cross section (with a non-circularity index of 1.24) and exhibited a porosity of 62.4%, a strength of 5.06 g/d, an elongation of 22.1%, and a fineness of 2.8 dpf. When the surface and cross section of a sample of these fibers were examined by means of a scanning electron microscope, slit-like pores as shown in FIG. 2 were observed throughout the fiber.

A fabric was made of these fibers and compared with another fabric made of circular section fibers having the same fineness and porosity. As a result, the fabric made of the above-described non-circular section fibers had greater bulkiness and a softer touch.

Example 13

Porous polyethylene fibers having a Y-shaped cross section were prepared by repeating the sam spinning and stretching procedures as described in Example 1, except that the Y-hole spinneret of Example 12 was used. The fibers thus obtained had a porosity of 67.2%, a tensile strength of 4.6 g/d, an elongation of 36 8%, and a fineness of 1.8 dpf.

Using these non-circular section fibers or the circular section fibers obtained in Example 1, bundles of 30,720 fibers were made and then enlosed in paper to form cylindrical filters. Thereafter, these filters were cut in lengths of 17.0 mm and their flow resistance was measured by blowing air therethrough at a rate of 17.5 cc/sec. The perimeters of the filters and the measured values of flow resistance are given in Table 3.

TABLE 3

| Material | Perimeter (mm) | Flow resistance (mm $H_2O$) |
|---|---|---|
| Non-circular section fibers | 23.6 | 62.8 |
| Circular section | 20.4 | 88.2 |

TABLE 3-continued

| Material | Perimeter (mm) | Flow resistance (mm $H_2O$) |
|---|---|---|
| fibers of Example 1 | | |

Since the non-circular section fibers had greater bulkiness, the filters made thereof had a larger perimeter. Moreover, since these fibers had more space therebetween, the filters exhibited lower flow resistance and better performance stability. In contrast, the filter made of circular section fibers had higher flow resistance and showed considerable variation in performance.

Example 14

Using a spinneret having 60 X-shaped holes with a cross-sectional area of 1.38 $mm^2$, the same high-density polyethylene as used in Example 1 was spun at a spinning temperature of 175° C. and taken up at a speed of 400 m/min with a spinning draft of 756. The spun fibers were passed through a slow cooling zone provided beneath the spinneret and having a length of 2.5 m and an ambient temperature of 60° C. therein. Thereafter, employing the same conditions as described in Example 1, the unstretched fibers were heat-treated, stretched and thermally set under a relaxed condition to obtain porous polyethylene fibers. These fibers had a distinctly X-shaped cross section (with a non-circularity index of 1.45) and exhibited a porosity of 54.6%, a tensile strength of 2.8 g/d, an elongation of 55.6%, and a fineness of 2.7 dpf. When these fibers were bundled in the same manner as described in Example 13 and compare with circular section fibers having the same fineness and porosity the former exhibited better bulkiness.

As described above, the porous polyethylene fibers of the present invention have a high porosity of 50 to 80% and their porous structure contains pores communicating with each other anywhere from the surface to the center of the fiber. Thus, they have a very large surface area per unit weight, as well as very light weight and a soft feeling. Moreover, they are clean white fibers showing no signs of transparency. Further, since their porous structure is such that the pores defined by lamellar and a large number of fibrils interconnecting the lamellar communicate with each other, they exhibit excellent mechanical properties in spite of their high porosity. In addition, since the porous polyethylene fibers of the present invention are prepared solely by melt spinning and stretching, they are a hygienic material free of impurities such as solvents and additives, and are suitable for the manufacture of next-to-skin wear and medical cloths. Furthermore, owing to the above-described very large surface area per unit weight and to the lipophilic nature of polyethylene, they are also useful as a material for the manufacture of wipers and various adsorbents including cigarette filters.

What is claimed is:

1. A porous polyethylene fiber without a central cavity extending along the longitudinal axis thereof, and having (a) a porous structure containing pores defined by lamellar crystal portions and a large number of fibrils interconnecting the lamellar crystal portions, said pores communicating with each other anywhere from the surface to the center of the fiber, (b) a porosity of 50 to 80%, (c) a tensile strength of 1 to 8 g/d, (d) an elongation of 1 to 300% and (e) a denier of 0.5 to 5 denier per fiber.

2. The porous polyethylene fiber of claim 1 which has a non-circular cross section.

3. The porous polyethylene fiber of claim 1 or 2 which has a porosity of 55 to 75%.

4. The porous polyethylene fiber of claim 1 or 2 which has a tensile strength of 2 to 6 g/d and an elongation of 5 to 150%.

* * * * *